US009227450B2

(12) United States Patent
Faber

(10) Patent No.: US 9,227,450 B2
(45) Date of Patent: Jan. 5, 2016

(54) SELF-INKING STAMP WITH A STAMP HOUSING

(71) Applicant: COLOP Stempelerzeugung Skopek Gesellschaft m.b.H. & Co. KG., Wels (AT)

(72) Inventor: Ernst Faber, Wels (AT)

(73) Assignee: COLOP Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 14/760,652

(22) PCT Filed: Jan. 21, 2014

(86) PCT No.: PCT/AT2014/050025

§ 371 (c)(1),
(2) Date: Jul. 13, 2015

(87) PCT Pub. No.: WO2014/113834

PCT Pub. Date: Jul. 31, 2014

(65) Prior Publication Data

US 2015/0352876 A1 Dec. 10, 2015

(30) Foreign Application Priority Data

Jan. 24, 2013 (AT) ..... A 50051/2013

(51) Int. Cl.
*B41K 1/40* (2006.01)
*B41K 3/56* (2006.01)
(Continued)

(52) U.S. Cl.
CPC ... *B41K 3/56* (2013.01); *B41K 1/36* (2013.01); *B41K 1/40* (2013.01); *B41K 1/52* (2013.01)

(58) Field of Classification Search
CPC ..... B41K 1/00; B41K 1/02; B41K 1/1006; B41K 1/36; B41K 1/40; B41K 1/42; B41K 1/50; B41K 1/52; B41K 1/54; B41K 1/56; B41K 3/54; B41K 3/56
USPC ..... 101/333, 334, 405
See application file for complete search history.

(56) References Cited

U.S. PATENT DOCUMENTS
3,063,371 A 11/1962 Lowell et al.
4,579,057 A * 4/1986 Hewitt ..... B41K 1/02 101/368

(Continued)

FOREIGN PATENT DOCUMENTS
AT 3176 U1 11/1999
AT 004 935 U1 1/2002

(Continued)

OTHER PUBLICATIONS
International Search Report of PCT/AT2014/050025, mailed Aug. 11, 2014.

(Continued)

*Primary Examiner* — Blake A Tankersley
*Assistant Examiner* — Marissa Ferguson Samreth
(74) *Attorney, Agent, or Firm* — Collard & Roe, P.C.

(57) ABSTRACT
The invention relates to a self-inking stamp (1) comprising a stamp housing (2) in which a reversible stamp unit (20) and a receiving space (6) for an ink pad container (5) are arranged, an actuation part (3) which is mounted on the stamp housing (2), and which can be displaced relative thereto from an upper rest position to a lower printing position, which pivotably supports the stamp unit (20), and a window part (4) which is at least partially transparent, detachably mounted by a clip connection on the actuation part (3) and through which the print card (12) arranged inside the window part (4) is visible. When the window part (4) is mounted on the actuation part (3), two opposing walls cover the actuation part (3) when it is in the upper rest position, and extend downwards over the receiving space (6), and cover the latter, the window part being mounted so that it can be displaced up and down on the actuation part (3). In the upper rest position, the actuation part (3) releases the receiving chamber (6) for the ink pad container (5).

10 Claims, 5 Drawing Sheets

Figure 1:
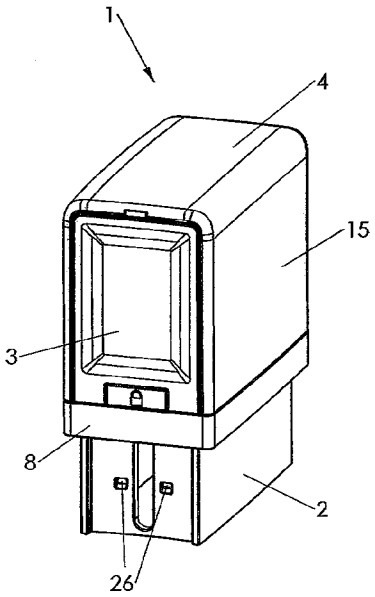

(51) Int. Cl.
*B41K 1/36* (2006.01)
*B41K 1/52* (2006.01)

(56) References Cited

U.S. PATENT DOCUMENTS

| | | | | |
|---|---|---|---|---|
| 5,152,223 | A | 10/1992 | Mairon | |
| 5,517,916 | A * | 5/1996 | Dour | B41K 1/40 101/104 |
| 5,743,186 | A | 4/1998 | Liao | |
| 5,768,992 | A | 6/1998 | Daw et al. | |
| 6,761,114 | B2 | 7/2004 | Koneczny et al. | |
| 6,994,025 | B1 * | 2/2006 | Faber | B41K 1/56 101/104 |
| 7,069,852 | B2 * | 7/2006 | Zindl | B41K 1/54 101/104 |
| 7,086,331 | B2 * | 8/2006 | Moody | B41K 1/52 101/327 |
| 7,389,727 | B2 | 6/2008 | Faber | |
| 7,464,643 | B2 | 12/2008 | Pointl | |
| 2004/0007144 | A1 | 1/2004 | Koneczny et al. | |
| 2004/0025727 | A1 | 2/2004 | Faber | |
| 2004/0035310 | A1 | 2/2004 | Zindl | |
| 2005/0056173 | A1 | 3/2005 | Dour | |
| 2005/0066828 | A1 | 3/2005 | Wei | |
| 2006/0000374 | A1 | 1/2006 | Faber | |
| 2006/0162596 | A1 | 7/2006 | Faber | |
| 2007/0169650 | A1 | 7/2007 | Shih | |
| 2007/0272099 | A1 * | 11/2007 | Pointl | B41K 1/40 101/104 |
| 2009/0229482 | A1 | 9/2009 | Shih | |
| 2010/0170813 | A1 | 7/2010 | Faber | |
| 2011/0277647 | A1 | 11/2011 | Zindl et al. | |
| 2012/0297998 | A1 | 11/2012 | Zehetner et al. | |

FOREIGN PATENT DOCUMENTS

| | | | |
|---|---|---|---|
| AT | 6265 | U1 | 7/2003 |
| AT | 7861 | U1 | 10/2005 |
| AT | 507 692 | A1 | 7/2010 |
| AT | 507 833 | A2 | 8/2010 |
| AT | 414 342 | B | 9/2011 |
| AT | 511 453 | A4 | 12/2012 |
| DE | 634 393 | C | 8/1936 |
| DE | 32 00 551 | A1 | 7/1983 |
| DE | 69601069 | T2 | 6/1999 |
| EP | 0 803 372 | A1 | 10/1997 |
| EP | 0 807 531 | A1 | 11/1997 |
| EP | 1 280 669 | B1 | 2/2007 |
| EP | 1 603 754 | B1 | 8/2007 |
| EP | 1 603 755 | B1 | 8/2007 |
| FR | 2 127 114 | A5 | 10/1972 |
| WO | 01/83226 | A1 | 11/2001 |
| WO | 01/83227 | A1 | 11/2001 |
| WO | 2004/060685 | A1 | 7/2004 |
| WO | 2004/091923 | A1 | 10/2004 |
| WO | 2005/037565 | A1 | 4/2005 |
| WO | 2006/119597 | A2 | 11/2006 |

OTHER PUBLICATIONS

International Search Report of PCT/AT2014/050022, mailed Jun. 4, 2014.

International Search Report of PCT/AT2014/050023, mailed Jul. 16, 2014.

International Search Report of PCT/AT2014/050024, mailed Jul. 8, 2014.

Austrian Office Action in A 50051/2013-1, dated Nov. 29, 2013, with an English translation of relevant parts.

Austrian Office Action in A 50052/2013-1, dated Nov. 29, 2013, with English translation of relevant parts.

Austrian Office Action in A 50053/2013-1, dated Nov. 29, 2013, with an English translation of relevant parts.

Austrian Office Action in A 50054/2013-1, dated Nov. 29, 2013, with an English translation of relevant parts.

Anleitung zum Zusammensetzen der Stempel [Instruction for construction of the stamps] [online], [discovered on Nov. 29, 2013]. Discovered on the website: •URL:http//www.vistaprint.de/stempel-montage-anleitung.aspx?GP=11%2f29%2f2013+5%3a29%3a37+Am&GPS=3026443255&GNF=1•.

* cited by examiner

SELF-INKING STAMP WITH A STAMP HOUSING

CROSS REFERENCE TO RELATED APPLICATIONS

This application is the National Stage of PCT/AT2014/050025 filed on Jan. 21, 2014, which claims priority under 35 U.S.C. §119 of Austrian Application No. A 50051/2013 filed on Jan. 24, 2013, the disclosure of which is incorporated by reference. The international application under PCT article 21(2) was not published in English.

The invention relates to a self-inking stamp comprising a stamp housing in which a reversible stamp unit and furthermore a receiving chamber for an ink pad container are arranged, an actuation part which is mounted on the stamp housing and which can be displaced relative thereto from an upper rest position to a lower printing position, which pivotably supports the stamp unit, and a window part, at least partially transparent and generally U-shaped in cross-section, which is detachably mounted on the actuation part by a clip connection, and through which a print card arranged inside the window part is visible.

Self-inking stamps having a so-called upper stop inking, in which a stamp unit is moved in a stamp housing from an upper inking position to a lower printing position with the help of a turning mechanism, have long been well-known. The turning and downward movement of the stamp unit is effected by means of an actuation element, herein called yoke-shaped actuation part, which can be vertically reciprocated relative to the stamp housing from a rest position to an operating position. The actuation part comprises at least two side legs opposite to each other, by means of which the stamp unit, also called stamp plate unit, is rotatably coupled via an axle or protruding journals of the axle, the journals or the axis protruding through a longitudinal slot in the stamp housing from inside the stamp housing from the stamp unit arranged there to the actuation part present on the outside.

It is also known with such stamps to attach a printed sheet on the upper side of the actuation part as an information relating to the stamp print that can be produced, whereby for this purpose, a transparent observation window, which is at least partially transparent, is attached to the actuation part above the print sheet, cf. e.g. AT 3176 U1, but also EP 1 603 754 B1, WO 01/83227 A1 or WO 2005/037565 A. In particular, as can be seen from AT 3176 U1, the curved printed sheet at the inside of the observation window, hereinafter called window part, is fixed in a snap-type manner above projections of the window part projecting inwards, whereupon the window part is, together with the printed sheet locked, on the actuation part with the help of these very projections.

In the case of the self-inking stamp according to WO 2005/037565 A1, the window part is provided with downward extending walls adjacent on this actuation part on two opposite sides of the actuation part, to be able to accommodate, if necessary, a larger actuation sheet, if needed, with additional information of the owner of the stamp, within the window part.

However, the window part normally terminates in the upper rest position of the actuation part, in which the receiving chamber or space for an inkpad container including the inkpad is accessible from the outside, above said receiving chamber or duct, so that in this rest position the inkpad container can be inserted in the receiving chamber or be removed therefrom, for instance, to impregnate the inkpad with ink or change the inkpad container. As a matter of fact, in these known self-inking stamps the window part on the actuation part is attached to be detachable, but in a fixed, that is unmovable manner. In the known self-inking stamps the window part accordingly forms a virtually fixed component of the actuation part.

It has been found with such self-inking stamps that the inkpad container contained in the receiving chamber of the stamp housing sometimes is pushed out of the receiving chamber involuntarily at least partially together with the inkpad or stamp pad, thus resulting in an undesirable coloring of one's fingers or even soiling of other objects. It is also conceivable that the inkpad container in the cited rest position is somewhat pushed out of its receiving chamber and thus impedes a downward movement of the actuation part relative to the stamp housing, when a stamp print is to be produced. Then, the inkpad container must be pushed again into the proper position within the receiving chamber, so that thereafter, the desired print can be made.

In similar self-inking stamps, such as according to AT 507833 A2 or U.S. Pat. No. 5,743,186 A, it is also known to arrange the opening or slots for the inkpad containers in the upper rest position of the actuation part relative to the stamp casing in a manner offset to each other, so that for pushing the inkpad container in and out a relative movement of the actuation part and the stamp casing must be effected. Among other things, this involves cumbersome handling, however.

In other known self-inking stamps, e.g. according to WO 2006/119597 A2 or EP 803 372 B1 (DE 696 01 069 T2), first an upper cover of the actuation part, which has been snapped on, must be removed, so that the inkpad container can be inserted or removed; this is relatively difficult to produce and inconvenient to operate.

In the self-inking stamps according to the above cited WO 01/83227 A1 a transparent hood part, which in the normal or rest position of the actuation part covers the receiving space for the inkpad container on the stamp front side with an extension, is pivotably connected to the rear side of the actuation part so that the receiving space for the inkpad container on the front side of the stamp can be made accessible by pivoting the hood part. The pivot bearing of the hood part is relatively complex to produce, in which connection it is difficult to realize an exact positioning of the hood part in the closed position, and moreover, the pivot bearing is unreliable in terms of operation and easily breaks loose.

The invention aims to provide a remedy here, and it is the object to propose a self-inking stamp as cited above, in which an unwanted or random shifting, even if only partially, of the inkpad container out of its receiving chamber in the rest position of the stamp can be prevented in a reliable manner by simple means, in order to prevent the described impediment or risk of soiling in the event of an at least partially projecting inkpad container.

Accordingly, according to the invention the self-inking stamp as described above is characterized in that the window part extends, in the position mounted on the actuation part with two opposite walls, downwards across the receiving chamber and covers the same, when the actuation part is in the upper rest position, that the window part is supported on the actuation part in a manner slidable up and down, and that in its upper rest position the actuation part leaves free the receiving chamber for the ink pad container.

At the present self-inking stamp, hereinafter called stamp in short, the window part thus can be moved vertically relative to the actuation part, whereby in the lower position, i.e. the normal position, it covers the openings of the receiving chamber for the inkpad container (as far as receiving chamber openings are provided on two opposite sides of the stamp), even if the actuation part is in its upper rest position or inking position. The window part is thus always moved in connection with the actuation part, whenever stamp prints are to be produced and then the stamp is moved again into its rest or stamp inking position. If, however, the inkpad container is to be pushed out of the receiving chamber, for example, to be exchanged or impregnated with ink (stamp ink), the window part is pushed upwards relative to the actuation part, so that then access to the inkpad container is possible—at least on one side.

It is of particular advantage if at least one wall of the window part comprises a stop or snap element, which upon pushing up the window part relative to the actuation part will be adjacent on a stop or snap connection part formed for instance by a wall recess on the actuation part. The movement of the window part relative to the actuation part towards the top is limited by these stop or snap connection elements, so that the window part is not pushed off entirely, unless wanted. Of course, however, this stop or snap or look connection can also be overcome, for instance, by slightly bending the at least one wall of the window part, so that it is possible to take the window part completely off the actuation part, for example, if it is desired to have access to the upper side of the actual actuation part, for instance, to insert a print card.

On the other side, it is also particularly advantageous if a clip element is provided on at least one wall of the window part, preferably on the free lower end, which clip element can be locked with a corresponding clip part on the actuation part or preferably with a separate frame part coupled to the actuation part in the mounted position. Thus, it is ensured that the window part is carried along with the actuation part, possibly via the frame part connected there between, i.e. the joint movement of window part and actuation part for the normal case is ensured.

Furthermore, with respect to a design as simple as possible, it is of advantage if the stop element simultaneously forms the clip element. Of course, it would also be conceivable to provide the stop element and the clip element separate from one another.

In the present self-inking stamp comprising a window part which is vertically adjustable relative to the actuation part it is further expedient if—instead of inside the window part—a print card receiving element is provided on an upper web of the actuation part. In this manner a print card is attached directly on the actuation part, on its top side, on the upper web, which print card reproduces the respective printing plate and thus provides the important printing information necessary for stamping. The upper web of the actuation part just like the upper web of the window part may be curved in a convex form, as has been known from the prior art, however, in the present stamp it is also easily possible with respect to a production as inexpensive as possible and a convenient operation of the stamp to provide the upper webs of to the actuation part and the window part so as to be plane, and in particular also in a manner perpendicular to the lateral walls of the window part and the actuation part.

Furthermore, it is favorable here if the print card receiving means is provided with lateral support projections encompassing the print card. The cited support projections may take the shape of simple ledges, which, if suitable, may be formed to be non-continuous, on the edge of the print card receiving means. It is possible to insert the print card over its length from the side into its receiving chamber or out of it, when the window part is pushed up into an intermediate position.

The window part with its comparatively large wall surfaces on opposite sides further offers a particular advantageous possibility to attach a sheet for further information, and therefore it is of advantage if a receiving space for an information sheet is arranged inside the window part, preferably limitations being provided to hold the information sheet, which is also U-shaped e.g. in cross-section, on the outer side of the actuation part or preferably on the inner side of the window part. The information is also visible or readable through the window part walls which at least in this zone are transparent, and e.g. all sorts of information may be provided, i.e. relating to the owner of the stamp, if desired, with a photograph of the stamp owner; the information sheet may also be designed in special colors, to give the stamp a special appearance on the whole. Subsequently, the information sheet is also called image card in short.

Nevertheless, to enable a view of the print card present on the top of the stamp, the information sheet comprising a U-shaped cross-sectional form in a comparable manner similar to the window part, comprises a recess in its upper web, through which the print card is visible.

With respect to an advantageous multiple use it is then favorable if the stop element on the window part forms at the same time one of the limitations for the information sheet.

Further, it is advantageous if the window part comprises on two open front sides projections that are inwardly projecting from its walls and preferably ledge-shaped, as limitations for the information sheet.

Figure 2:
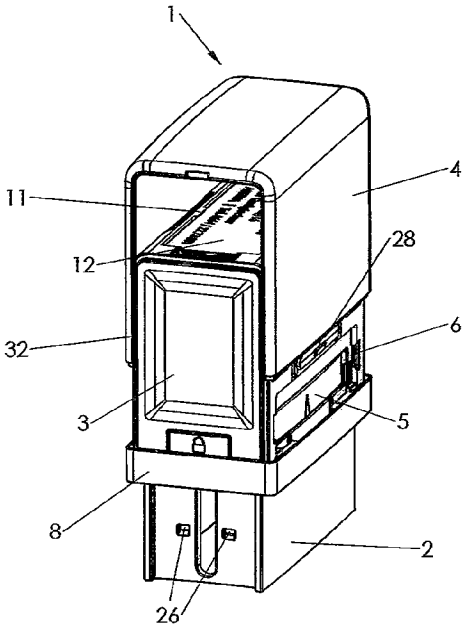
Figure 3:
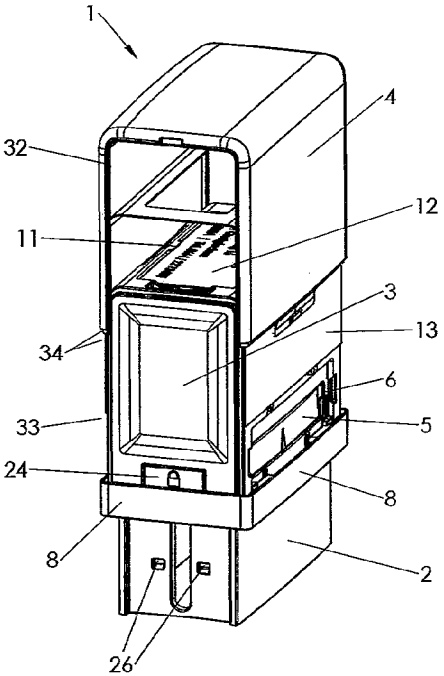
Figure 2A:
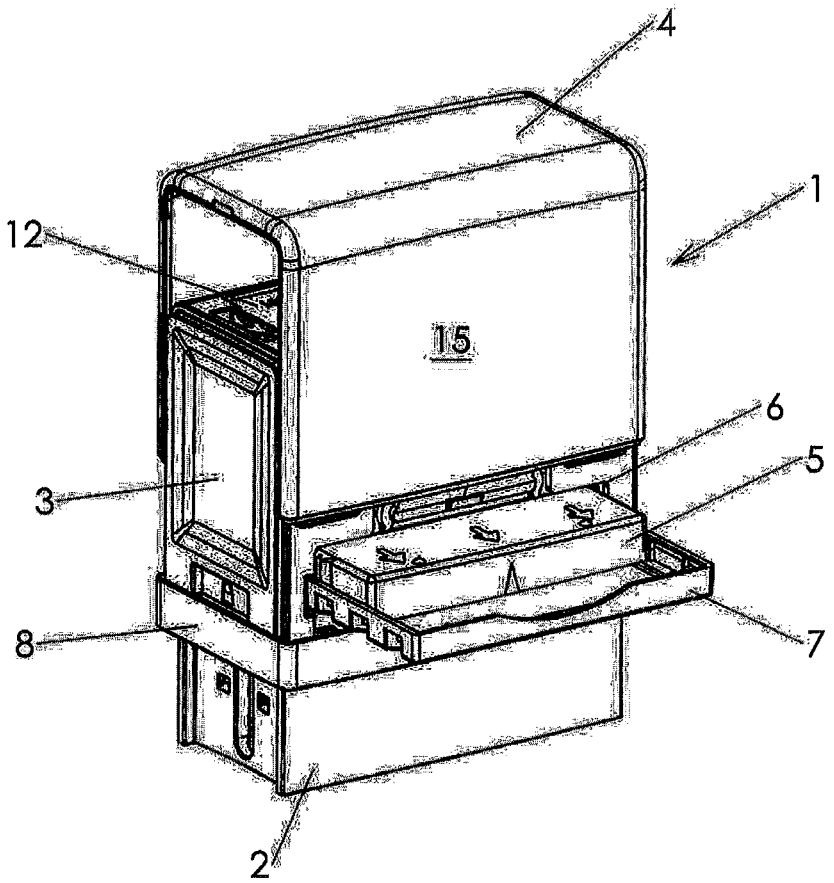
Figure 5:
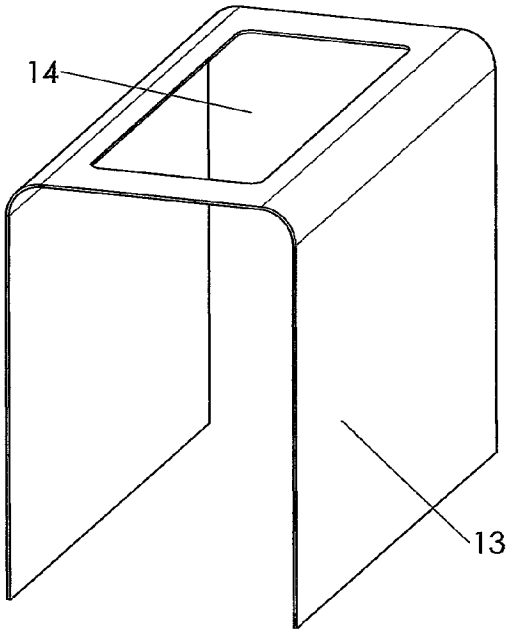
Figure 4:
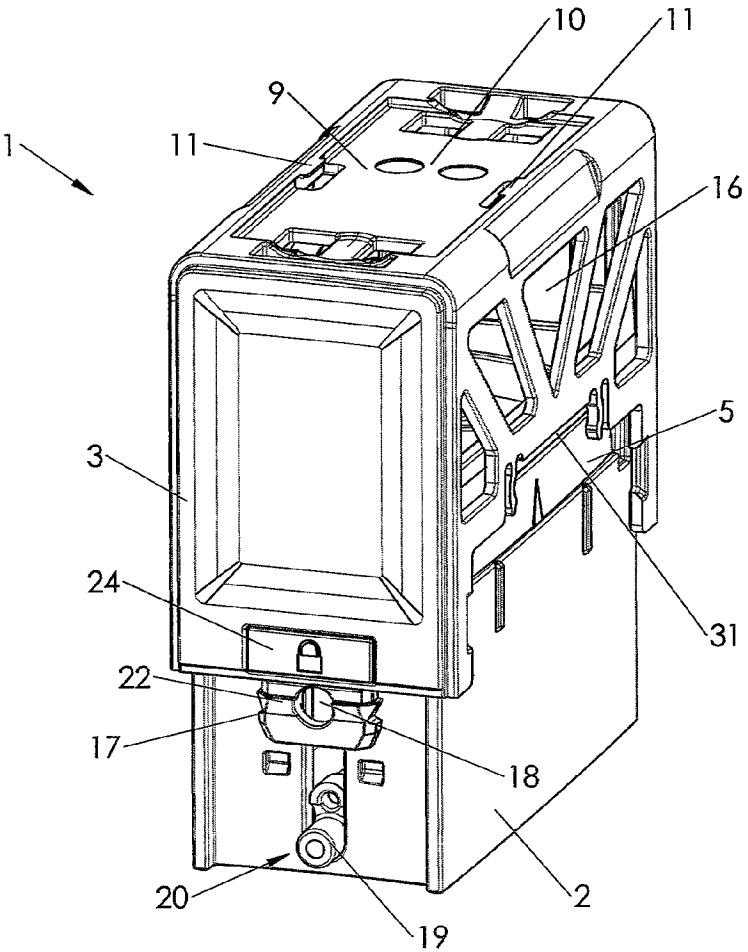
Figure 6:
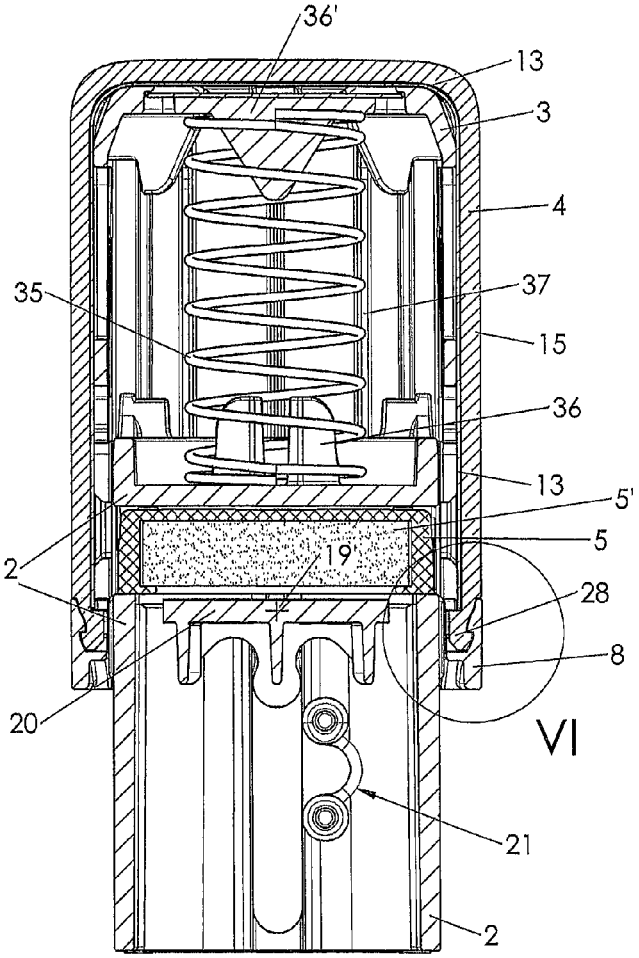
Figure 6A:
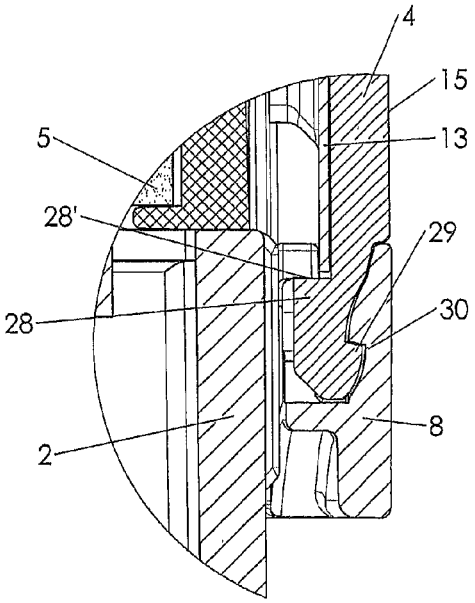
Figure 7A:
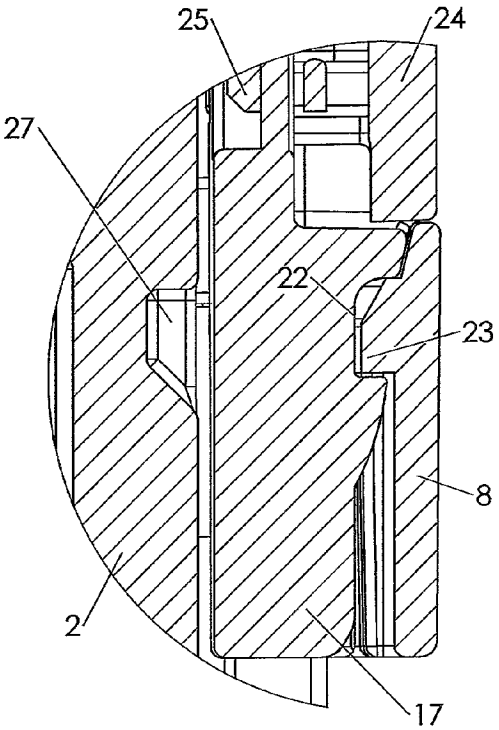
Figure 7:
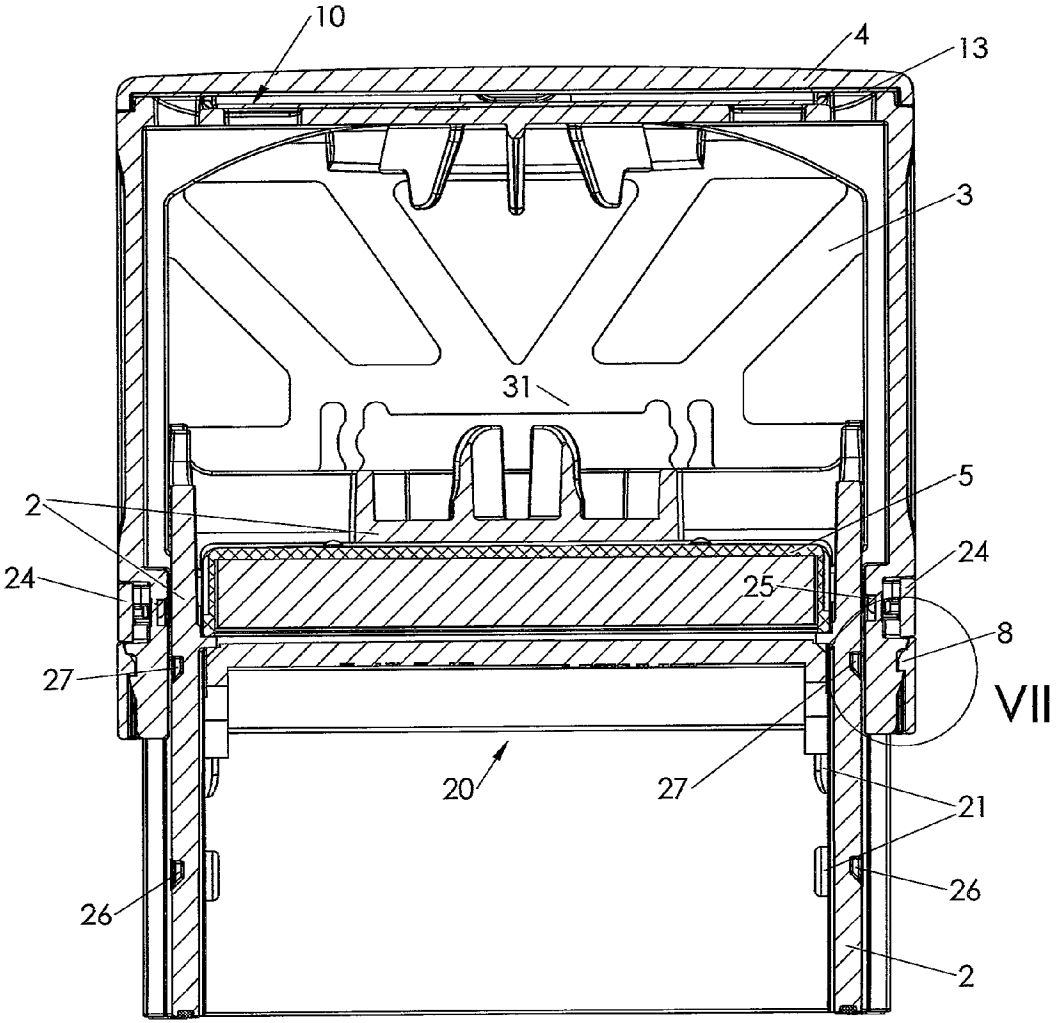

Below, the invention will be described with reference to particularly preferred exemplary embodiments to which it should, however not be limited, with reference being made to the drawing. In detail, the drawing shows as follows:

FIG. 1 a diagram view of a self-inking stamp according to the invention;

FIG. 2 a similar diagram view of the self-inking stamp, in which however the window part is pulled up relative to the remaining stamp;

FIG. 2A a comparable diagram view, similar to FIG. 2, of the stamp upon changing the ink pad container;

FIG. 3 a comparable diagram view of the stamp, in which now the window part has been pushed up further, and in which a print card as well as an information sheet (an "image card") can be seen within the window part;

FIG. 4 a diagram view of the stamp, with the window part just like the frame part below the actuation part having been removed;

FIG. 5 a diagram view of an information sheet having a recess on the top side;

FIG. 6 a vertical cross-section through the stamp to illustrate the snap connection between the window part and the separate frame part, which in the normal case is coupled to the actuation part;

FIG. 6A an enlarged cross-sectional view of the detail shown by a circle VI in FIG. 6, to illustrate in more detail the snap connection between the window part and the frame part;

FIG. 7 a vertical longitudinal section through the stamp, to illustrate the snap connection between the actuation part and frame part; and FIG. 7A, again in an enlarged scale, the detail shown by the circle VII in FIG. 7, to better illustrate the snap connection between the actuation part and the separate frame part.

FIG. 1 shows a self-inking stamp 1 in its normal rest position, in which an actuation part 3 placed on the top of a stamp housing 2 adopts its upper position. On the outer side of said actuation part 3, a window part 4 having the form of a reversed U in cross-section is attached, apart from FIG. 1 cf. also FIGS. 2, 2A and 3, said window part 4 being vertically displaceable relative to the actuation part 3, i.e. first into a stop position shown in FIG. 2 or FIG. 2A, and in which for instance exchanging (pushing inwards or withdrawing) an ink pad container 5 is possible, said exchange being particularly shown in FIG. 2A. In the normal position, such as is shown in FIG. 1, however, the window part 4 covers the ink pad container 5 or generally the receiving chamber 6 for this ink pad container 5. However, in its upper rest position, the actuation part 3 does not, as can be seen directly from FIGS. 2, 2A and 3, cover the receiving chamber 6, that means it keeps it free. For instance, as may be seen from FIG. 2A, for exchanging the ink pad container 5 a separate guide part or receiving container 7 can be placed at the stamp housing 2 in the area of the opening of the receiving chamber 6, whereby the ink pad container 5 can be pushed from this guide receiving container 7 into the receiving chamber 6 in the stamp housing 2 or out of it and onto the guide receiving container 7. However, this process of exchanging the ink pad container 5 does not constitute the subject matter of the present invention and will not be further described.

A separate lower frame part 8 in the operating position is connected to the actuation part 3. In the normal case, this frame part 8, as will be explained below in further detail on the basis of FIG. 7 and FIG. 7A, is locked with the actuation part 3 on the narrow sides of the stamp 1.

The window part 4 is locked with this frame part 8 on the two broadsides of the stamp 1 which is e.g. rectangular in cross-section, if the stamp 1 is in the normal position according to FIG. 1. Such locking will be explained below in further detail on the basis of FIGS. 6 and 6A.

As can be seen in particular from FIGS. 2, 2A and 3, a print card receiver 10 is provided on the upper side of the actuation part 3, on the upper wall or web 9 present there, cf. also FIG. 4, in the present example, this web 9 and thus also the print card receiver 10 for example being plane; however, a convex shape would also be conceivable, as is known e.g. from the prior art. The print card receiving element 10 comprises ledge-shaped support projections 11, which are provided for instance on the two longitudinal sides, if required, also on the shorter transverse sides of the print card receiving element 10, and which hold a print card 12 inserted in this receiving element 10 and fix it in its position, cf. FIGS. 2 and 3. As is shown, in the case of support projections 11 on the longitudinal sides, the print card 12 may particularly easily be mounted or removed by longitudinally pushing it into the receiver 10 or out of it, for this purpose the window part 4 being pushed upwards and into the position according to FIG. 2 or FIG. 3.

Furthermore, an information sheet 13, subsequently also called image card 13, is placed within the window part 4, cf. apart from FIG. 3 in particular also FIG. 5. As can be seen in particular from FIG. 5, this image card 13 is folded or bent in cross-section in an essentially U-shaped manner just like the window part 4, and it comprises a recess 14 corresponding to the print card 12 on its web upper side, so that in the case of assembled stamps the print card 12 is visible through the transparent window part 4 as well as through this recess or opening 14. The image card 13 can have additional information on the outside of its two sidewalls, such as the names and/or an image of the owner of the stamp 1 and the like; in particular, the image card 13 can also have a certain signal color which is visible through the transparent window part 4, to give the upper part of the stamp 1 a colored design accordingly, as can be seen from FIG. 1.

The remaining main components of the stamp 1, that is the stamp housing 2 and the actuation part 3 may be designed for instance in a neutral color, in particular in white, so that the coloring of the image card 13 is clearly visible through the transparent vertical walls 15 (FIG. 1) of the window part 4.

In FIG. 4 the stamp 1 is shown without window part 4, and it can be seen that the actuation part 3 which is basically hood-shaped is placed on the top side of the stamp housing 2, in which connection the actuation bow part 3 may also be designed with different recesses 16 in order to save material.

On the bottom ends of its two narrow sides (comparable to legs) the bow part 3 comprises plate-like, comparably narrow bearing and locking projections 17, wherein in FIG. 4 only one of these projections 17 is visible. Each of these bearing projections 17 comprises a receiving bore 18 for the mounting of axle pins 19 of the stamp unit 20, said stamp unit 20 being shown in FIG. 4 in a state separated from the bearing projections. The narrow bearing and locking projections 17 can be elastically bent outwards, to allow the axle pins 19 to snap in or, on the other hand—for the removal of the stamp unit 20—to release them. As can also be seen from FIG. 6, a known turning mechanism, which is given numeral 21, for the stamp unit 20 is provided in the inside of the stamp housing, in which connection an exact description of this turning mechanism 21 and its co-action with the stamp unit 20 can be dispensed with, since it is well-known in the prior art. In FIG. 6, at numeral 19', the axis of the stamp unit 20 is schematically indicated, which is defined by the axle pins 19 on both sides, that is in particular when the axle pins 19 are received in the bearing bores 18.

The bearing projection 17 further comprises a transversely extending longitudinal locking recess 22, which serves to fix the separate frame part 8 via a locking projection 23 present thereon by means of locking. This locking connection is particularly illustrated in FIGS. 7 and 7A. It can be seen that the frame part 8 engages, with e.g. a ledge-shaped locking projection 23, in the locking recess 22, if the frame part 8 is connected to the actuation part 3, specifically with its bearing projections 17.

Furthermore, it can be seen from FIGS. 7 and 7A and also from FIG. 4 that a locking element 24 is provided on the actuation part 3 above the bearing projections 7 on the two narrow sides, which locking elements can be moved elastically inwards relative to the remaining actuation part 3, for instance via a spring connection to the remaining actuation part 3; with its projections 25 on the inner side (FIG. 7) this locking element 24 forms a clip or lock acting together with corresponding locking recesses 26, 27 on the narrow sides of the stamp housing, to be able to specifically fix the actuation part 3 on the stamp housing 2 at various pre-defined positions.

As can be seen in particular from FIG. 6A, the window part comprises on its broad sidewalls 15, on the lower end, an angled part 28 having a shoulder 28' and a locking hook 29, the latter engaging in a locking recess 30 of the frame part 8, if the window part 4 is connected to the frame part 8. The shoulder 28' forms a stop element 28', by means of which the window part 4 comes in engagement upon being pushed up relative to the actuation part 3 on a stop 31 formed by a recess on the corresponding wall of the actuation part 3, to thus limit the pushing up of actuation part 3 relative to the remaining stamp 1, cf. FIGS. 2 and 2A. Instead of such rectangular shoulder stop elements 28', 31, however, it would also be conceivable to provide corresponding locking elements, comparable to the locking elements 29, 30 between the window part 4 and the frame part 8, so that the window part 4 not only stops upon being pushed up relative to the actuation part 3, but is also fixed in this pushed-up intermediate position according to FIGS. 2 and 2A.

Then, FIG. 6 also shows for the sake of completeness a helical compression spring 35 acting in a conventional manner between the actuation part 3 and the stamp housing 2, which spring always urges the actuation part 3 into the upper rest position, according to FIG. 6. For the sake of completeness, FIG. 6 also shows in more detail the ink pad or stamp pad 5' contained in the ink pad container 5.

Furthermore, FIGS. 2 and 3 show ledge-shaped limitations 32 on the window part 4 on the narrow-side edges, which project inwards and thus retain the image card 13 in the inside of the window part 4. In addition, these ledge projections 32 can also be used to guide the window part 4 on the corresponding edges 33 of the actuation part 3, with corresponding slots or shoulders 34 being provided on these edges 33.

Of course, instead of being provided on the inside of the window part 4, the image card 12 could also be supported or pre-mounted on the outside of the actuation part 3, for this case comparable ledge-shaped limitations or supports, if needed with undercuts, being attached.

The invention has been explained in detail on the basis of the above cited especially preferred embodiments; however, it is clear that further modifications and variations are also possible within the scope of the invention. For instance, it is conceivable to design the stamp 1 instead of having an essentially rectangular cross-section also in square shape or oval or even circular shape in cross-section, with flattened "narrow sides", the flattened narrow sides enabling the design of virtually plane legs of the actuation part 3. It is also conceivable to omit the frame part 8 and provide a uniform actuation part 3 in a conventional manner; in this case, the locking connection as shown in FIG. 6 and in particular in FIG. 6A would have to be provided between the window part 4 and actuation part 3 instead of between the window part 4 and the frame part 8, in which connection corresponding modifications are within the scope of expert knowledge. The frame part 8, however, offers the advantage that the bearing and locking projections 17 may optionally be covered or exposed, the latter for instance in the case of assembling or disassembling the stamp unit 20.

Just like the remaining components 2, 3, 8 of the stamp 1, the window part 4 can be made of plastics, such as ABS or POM or PP, whereby the entire window part 4 is preferred to be a transparent part, so as to enable unlimited vision of the print card 12 as well as the image card 13.

FIG. 6 further shows centering projections 36, 36' for the spring 35 as well as guide ledges 37, to guide the actuation part 3 on the narrow sides of the stamp housing 2.

The invention claimed is:

1. A self-inking stamp (1) comprising:

a stamp housing (2) provided on a lower side of the self-inking stamp, in which a reversible stamp unit (20) as well as a receiving space (6) for an ink pad container (5) are provided, said receiving space (6) being provided in an upper region of the stamp housing (2);

an actuation part (3) which is mounted on top of the stamp housing (2) and can be displaced relative thereto from an upper rest position to a lower printing position, which actuation part pivotably supports the stamp unit (20);

an upper window part (4) detachably mounted by a clip connection on the actuation part (3), which window part is at least partially transparent and generally U-shaped in cross-section, through which a printed card (12) arranged inside the window part (4) is visible, wherein the window part (4) is supported on the actuation part (3) in a manner movable up and down relative to the actuation part between a lower normal position and an upper stop position, and wherein, in the lower normal position, with the actuation part (3) being in the upper rest position, the window part (4) with two opposite walls (15) extends downwards beyond said receiving space (6) for the inkpad container (5) provided in the upper region of the stamp housing (2) and covers the same, whereas in its upper rest position the actuation part (3) does not cover the receiving space (6) for the inkpad container (5).

2. The self-inking stamp according to claim 1, wherein at least one wall (15) of the window part (4) comprises a stop or snap element (28'), which upon pushing up the window part (4) relative to the actuation part (3) comes to rest against a stop or snap connection part (31) formed by a wall recess and provided on the actuation part (3).

3. The self-inking stamp according to claim 2, wherein the stop element (28') is formed in one piece with the clip element (29).

4. The self-inking stamp according to claim 1, wherein a clip element (29) is provided on at least one of the opposite walls (15) of the window part (4), wherein the clip element (29) can be locked with a corresponding clip part (30) on the actuation part (3) or preferably with a separate frame part (8) coupled to the actuation part (3) in the mounted position.

5. The self-inking stamp according to claim 1, wherein a print card receiver means (10) is provided on an upper web of the actuation part (3).

6. The self-inking stamp according to claim 5, wherein the print card receiver means (10) is provided with lateral support projections (11) encompassing the print card (12).

7. The self-inking stamp according to claim 1, wherein a receiving means for an information sheet (13) is arranged inside the window part (4).

8. The self-inking stamp according to claim 7, wherein the information sheet (13) comprises a recess (14) in its upper web, through which the print card (12) is visible.

9. The self-inking stamp according to claim 7, wherein a stop element (28') on the window part (4) forms at the same time a side projection (32) for the information sheet (13).

10. The self-inking stamp according to claim 7, wherein the window part (4) further comprises two open front sides projections (32) that are inwardly projecting from the opposite walls (15) as limitations for the information sheet (13).

* * * * *